US005167370A

United States Patent [19]

Henkel

[11] Patent Number: 5,167,370

[45] Date of Patent: Dec. 1, 1992

[54] METHOD AND DEVICE FOR THE INTERMITTENT INJECTION OF FUEL INTO THE COMBUSTION CHAMBER OF A COMBUSTION ENGINE

[75] Inventor: Dietmar Henkel, Neumarkt, Fed. Rep. of Germany

[73] Assignee: MAN Nutzfahrzeuge AG, Munich, Fed. Rep. of Germany

[21] Appl. No.: 613,270

[22] Filed: Nov. 14, 1990

[30] Foreign Application Priority Data

Nov. 15, 1989 [DE] Fed. Rep. of Germany ..... 3937917

[51] Int. Cl.[5] ..... F02M 47/06

[52] U.S. Cl. ..... 239/533.8; 239/533.3; 239/584

[58] Field of Search ..... 239/533.2, 533.3, 533.4, 239/533.5, 533.8, 533.9, 90, 584, 11

[56] References Cited

U.S. PATENT DOCUMENTS

| | | | |
|---|---|---|---|
| 3,628,736 | 12/1971 | Mowbray | 239/533.9 |
| 4,005,685 | 2/1977 | Kovacs et al. | 239/533.2 |
| 4,494,700 | 1/1985 | Dolenc | 239/533.3 |
| 4,552,310 | 11/1985 | Gaskell | 239/533.5 |
| 4,635,854 | 1/1987 | Ishibashi | 239/533.8 |
| 4,641,784 | 2/1987 | Howes | 239/533.8 |

FOREIGN PATENT DOCUMENTS

| | | | |
|---|---|---|---|
| 921368 | 11/1954 | Fed. Rep. of Germany | 239/533.3 |
| 1242368 | 8/1959 | France | 239/533.8 |
| 0169664 | 9/1985 | Japan | 239/533.3 |
| 0681206 | 8/1979 | U.S.S.R. | 239/533.4 |
| 494951 | 11/1938 | United Kingdom | 239/533.3 |

*Primary Examiner*—Andres Kashnikow
*Assistant Examiner*—Christopher G. Trainor
*Attorney, Agent, or Firm*—Robert W. Becker

[57] ABSTRACT

The invention relates to a method and a device for intermittently injecting fuel into a combustion chamber of a combustion engine. Efforts to reduce the emission of pollutants and the noise level of Diesel engines are geared towards a control of the heating process. According to the present invention this is achieved by employing the valve needle of the injection valve as a control member for the fuel supply into the pressure chamber of the valve body, whereby the valve needle is actuated to open and close the valve at a high frequency in short intervals. In conjuction with the high fuel pressure, a good droplet size distribution is realized which leads to a homogeneous fuel-air mixture. Dividing the fuel injection process into short intervals by relatively simple design measures results in an extended heating period which positively influences the $NO_x$ contents.

5 Claims, 3 Drawing Sheets

METHOD AND DEVICE FOR THE INTERMITTENT INJECTION OF FUEL INTO THE COMBUSTION CHAMBER OF A COMBUSTION ENGINE

BACKGROUND OF THE INVENTION

The present invention relates to a method and a device for intermittently injecting fuel into a combustion chamber of a combustion engine, wherein a closing and an opening of a valve needle of an injection valve is made possible exclusively by the interaction of a force source means acting in a closing position of the valve and a fuel pressure force acting on the valve needle.

In an injection valve, known from DE-OS 22 42 344, the injection process is exclusively controlled by the forces acting on the valve needle. On the one hand, the valve needle is maintained in its closing position by a pressure spring, on the other hand, the pressure exerted on the valve needle by the fuel pumped into the valve via the injection pump acts to lift the valve needle. In order to realize higher injection pressures without the need of increasing the force of the pressure spring above a reasonable value, the spring is assisted by an auxiliary piston acting in the closing position of the valve needle. When the pressure generated by the fuel exceeds the force of the pressure spring, fuel is injected into the combustion chamber of the combustion engine via an injection bore opened by the fuel pressure. When the pressure decreases, the force of the pressure spring and the auxiliary piston close the valve needle again. This known injection process, however, does not allow for multiple controlled opening and closing steps during one working cycle.

The higher requirements for cleaner exhaust gases may not be satisfied with the injection methods of the conventional injection valves. The exhaust fumes of Diesel engines must be reduced in their CH-contents as well as their carcinogenic soot particle contents that cause black exhaust fumes. At the same time, the $NO_X$ contents and the combustion noise must be reduced. These are, in part, quite contrary demands which may not be overcome by conventional injection methods It is therefore an object of the present invention to improve the aforementioned known methods and devices such that an injection method which allows for a control of the mixture formation process and the quality of the combustion process, which depends on the mixture formation process, is provided, whereby the contents of CH and soot may be decreased without increasing the $NO_X$ contents and, at the same time, the combustion noise level is reduced to a minimum.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
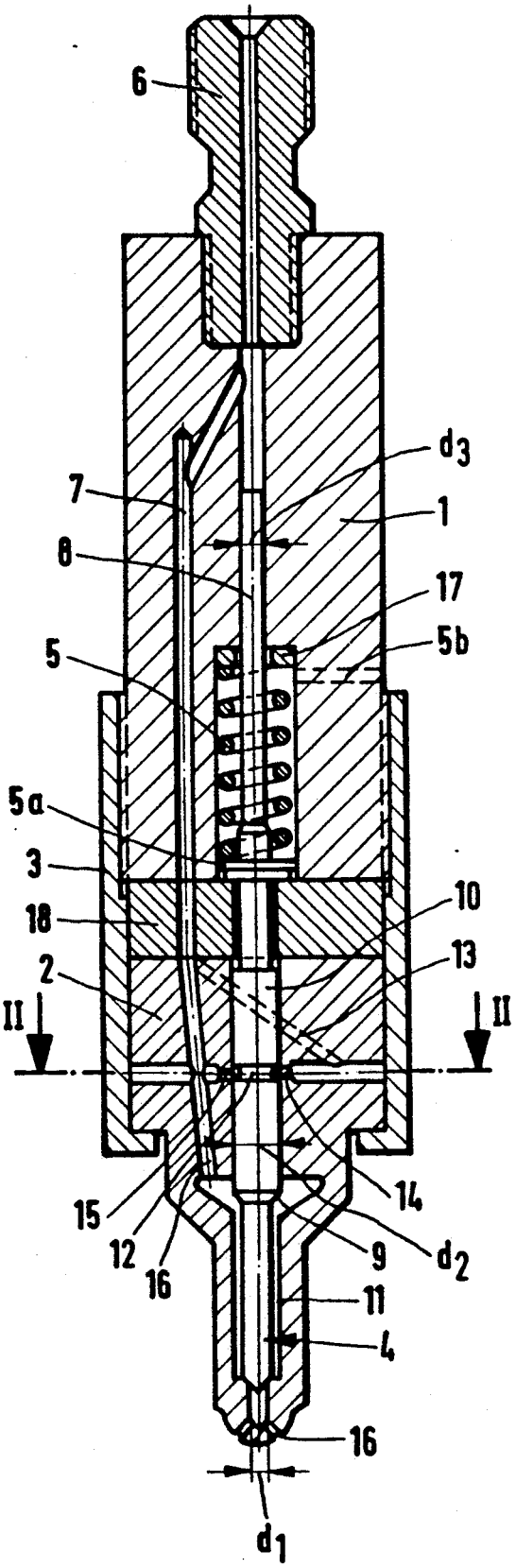
FIG. 1 is a cross-section in the longitudinal direction of an injection valve having a valve needle shaft as a control member.

The method of the present invention is primarily characterized by controlling the fuel pressure, acting on the valve needle in its closing position, by a movement of the valve needle such that a fuel path, in the closing position of the valve needle, from a fuel inlet bore to a pressure chamber of a valve body is open and, after said valve needle reaches an opening position, said fuel path is closed.

Since the valve needle itself function as the control member for the timing of the opening and closing of the valve, the improved mixture formation process may be achieved with comparably few design measures. As a result of such a modulation of the injected fuel quantity, the combustion process is characterized by a short ignition delay. The acoustically more than welcome noise reduction, in solids and also in air, is caused by the reduction of the speed of the combustion pressure increase which may even suppress the generation of standing wave fields in the combustion chamber. In return this may also have a positive effect on the $NO_X$ contents of the exhaust gases since the $NO_X$-producing high temperature peaks which occur at the local and time-dependent pressure maxima of the standing waves are eliminated also.

A device for intermittently injecting fuel into a combustion chamber of a combustion engine according to the method of the present invention is primarily characterized by a valve needle shaft having an annular notch for opening or closing a fuel path leading from a first groove, that is connectable via a connecting line to a fuel inlet bore, to a second groove, that is connected via a line to the pressure chamber, with the first and second groove being arranged in a same plane and along a common axis opposite from one another, whereby the fuel path is closed when the valve needle is in an opening position.

The fuel supply into the combustion chamber may be controlled by the annular notch in the valve needle shaft. The valve needle and the pressure spring represent an oscillation system in which the valve needle is actuated to carry out high-frequency oscillations due to the opening and closing of the fuel path into the combustion chamber. The injection process, which is usually a one-step process only divided into a pre-injection phase and a main injection phase, is thereby divided into a multitude of short intervals leading to the aforementioned improvements The control of the fuel supply into the combustion chamber with the aid of the control member, comprising the first and second groove interacting with the annular notch of the valve needle shaft, is an easily realized solution for dividing the injection process into short intervals without a major design change.

In another embodiment the annular notch is surrounded by an annular groove in a common plane, when the valve needle is in its closing position, whereby the annular groove is connected with the inlet line and the valve needle shaft is provided with at least one diagonal bore that opens the annular notch and the pressure shoulder.

In a further embodiment the force source means is assisted by an additional piston, whereby a spring seat 5a is the additional piston which is actuatable via a control line 5b in said valve holder 1 by a pressure generator that is controlled in conformity with the performance range. The opening pressure may then be adjusted to any desired requirements.

The control of the fuel supply is again achieved by the annular notch and the groove, and the connection of the annular notch to the pressure chamber is realized by a at least on bore in the valve needle shaft itself. This represent a very economical solution.

DESCRIPTION OF PREFERRED EMBODIMENTS

The present invention will now be described in detail with the aid of several specific embodiments utilizing FIGS. 1 through 9.

FIG. 1 represents a cross-section in the longitudinal direction of an injection valve. The valve comprises conventional main components such as a valve holder 1, a valve body 2 and a sleeve nut 3, which connects the valve holder 1 and the valve body 2. A valve needle 4 is guided inside the valve body 2, which is maintained in a closing position by a pressure spring 5. The fuel is supplied via a pressure-fast screw coupling 6 and a fuel inlet bore 7. In order to realize high fuel pressure without causing damage to the valve needle 4 and the valve needle seat, the pressure spring 5 is relieved by an auxiliary piston 8 which is loaded by the fuel pressure. The auxiliary piston 8, having a diameter $d_3$, contributes primarily to the closing force. The closing force is opposed by a force acting on the pressure shoulder 9 of the valve needle shaft 10. The effective pressure surface is determined by the difference between the diameter $d_2$ of the valve needle shaft 10 and the diameter $d_1$ of the valve needle seat.

According to the present invention the pressure chamber 11 is not constantly pressurized via the fuel inlet bore 7. In fact, the fuel supply into the pressure chamber 11 may be shut off by the valve needle shaft 10 or released by the annular notch 12. In he position represented in FIG. 1, i.e., the closing position, the fuel reaches the groove 14 via the fuel inlet bore 7 and a connecting line 13. In the position shown, the pressure chamber 11 may be pressurized via the annular notch 12, the second groove 15 and the line 16. The pressure exerts a force onto the valve needle 4, which equals the product of the hydraulic pressure and the piston surface corresponding to the diameter difference $d_2-d_1$. This force opposes the combined forces of the spring force and the force of the auxiliary piston 8, and it actuates the opening of the valve needle 4. The movement of the opening valve needle 4 causes the annular notch 12 to move upwards, and the valve needle shaft 10 shuts off the fuel supply. At the same time, the pressure in the pressure chamber 11 decreases due to the injection of a fuel portion via the valve bore 16 to such an extent, that the valve needle 4 falls back into its closing position. This opening and closing cycle is continued until the fuel pump element of the injection pump, which is not represented in FIG. 1, stops pumping fuel.

The actual "lifting frequency" of the valve needle, which is very high and usually in the kHz area, depends on the following parameters: the actual fuel pumping speed of the pumping element of the injection pump, the mass of the valve needle, the static and dynamic properties of the pressure spring, and the wave mechanical properties of the hydraulic path up-stream and downstream from the shifting valve.

In order to limit the oscillating movement of the valve needle 4, there is provided an abutment 18 between the valve body 2 and the valve holder 1 which is fastened in its position by the sleeve nut 3.

When a pressure generator equipped with a pressure regulator, for example, a gear pump, is provided, it is possible to form a spring seat 5a of the pressure spring 5 as a piston, thereby eliminating the pressure spring 5. The auxiliary piston 8 that is actuated by the fuel pressure may serve as a guide rod while the empty space, vacant due to the elimination of the pressure spring 5, is connected via a control line 5b, shown as a broken line, to a controllable pressure generator. This variant without the pressure spring 5 allows for the variation of the opening pressure such, that via the control line 5b of the spring seat 5a which is in the form of a piston, is actuated by a controllable hydraulic pressure. The opening pressure may be adjusted in a known manner via a pressure control that is controlled in conformity with the performance range, i.e., as a function of the actual engine parameters such as engine revolutions and engine load.

Figure 2:
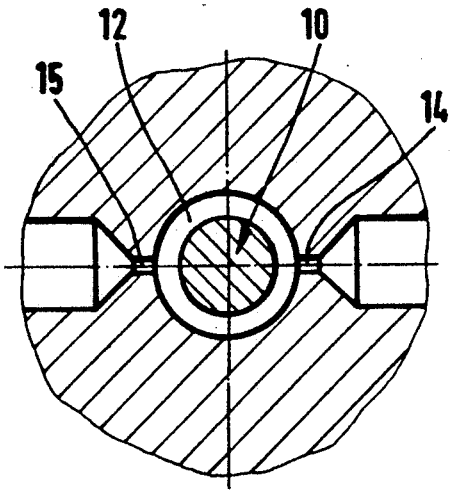
FIG. 2 is a cross-section, along the line II—II in FIG. 1, of the injection valve at the level of an annular notch of the valve needle.

FIG. 2 shows a cross-section, along the line II—II in FIG. 1, of the annular notch 12. The two grooves 14 and 15 extend only over a portion of the circumference, so that the path from the groove 14 to the second groove 15 may be separated by the valve needle shaft 10. Only the annular notch 12 may form the connection between the first groove 14 and the second groove 15 and the pressure chamber 11 (FIG. 1).

Figure 3:
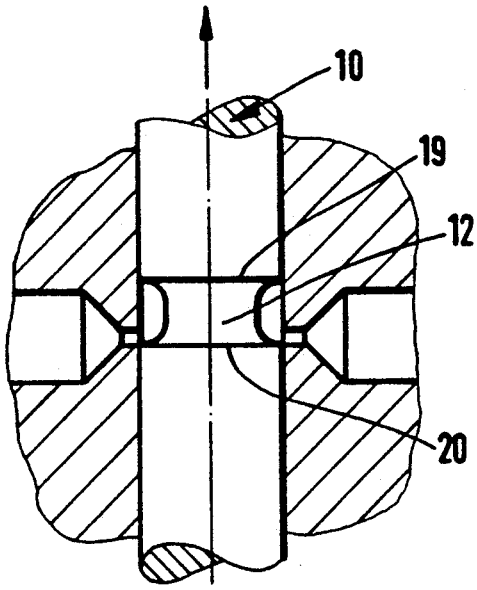
FIG. 3 shows a detail of a valve needle shaft having an annular notch.

A detail of the annular notch 12 is represented in FIG. 3. When passing a first control edge 19 the fuel is supplied via the grooves 14 and 15 into the pressure chamber 11 (FIG. 1). Upon further movement of the valve needle shaft 10 in the direction indicated by the arrow the fuel supply is shut off via the second control edge 20.

Figure 4:
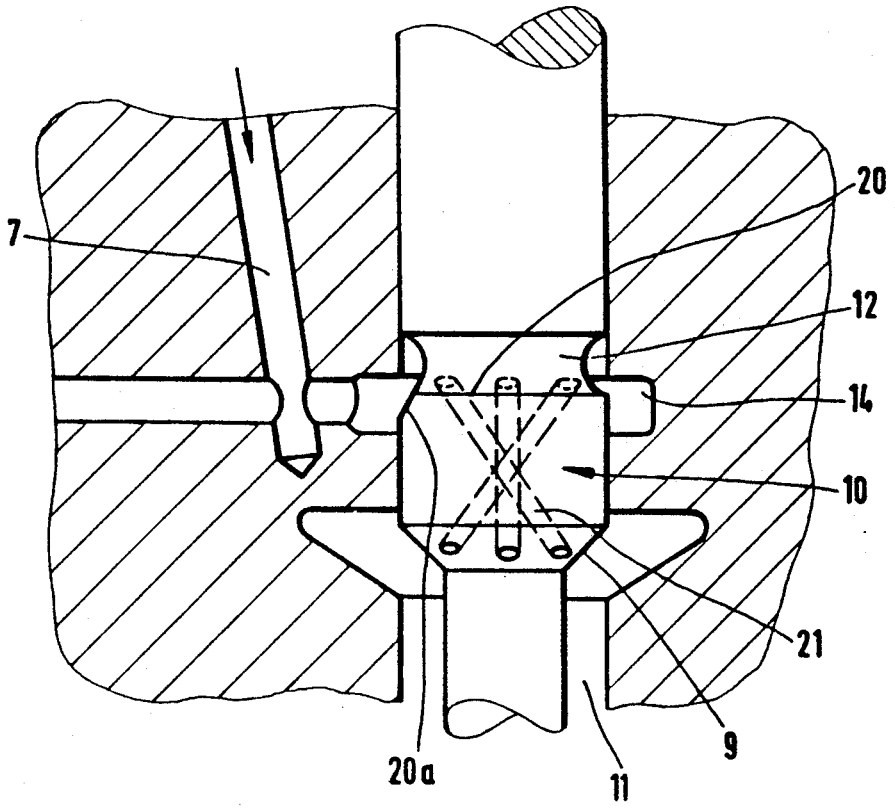
FIG. 4 shows a detail of a valve needle shaft having an annular notch and a bore to connect the annular notch and the pressure chamber.

Another variant of the shut off of the fuel supply is shown in FIG. 4. The fuel is supplied in a known manner via a fuel inlet bore 7 (cf. FIG. 1). The groove is represented as a peripheral annular groove 14 which is connected to the pressure chamber via the annular notch 12 and at least one bore 21 which diagonally penetrates the valve needle shaft 10. In the example represented, there are three such borings present. Furthermore, the pressure build-up in the pressure chamber 11 may be advanced via a slant 20a of the control edge 20, which is facing the pressure shoulder 9 of the valve needle 4. With a respective design of the slant, a slowdown of the closing movement of the valve needle 4 may be achieved which prevents the valve needle 4 from hitting the valve needle seat due to a reversal of the movement. The fuel stream passing through the valve bores is accordingly not interrupted periodically, but merely reduced periodically. Due to a modulation, at the same frequency, of the injection speed of the fuel jet leaving the respective valve bores, features of the atomization such as droplet size distribution, the angle of the jet cone and the average droplet penetration depth are also controlled periodically, thereby leading to the desired mixture homogenization. The advantages of a fuel stream modulation without interrupting the fuel jet are the following: undesirably large droplet diameters in the droplet size distribution are avoided to a large extent and, at the same time, knocking which causes deformations at the valve needle tip and the valve needle seat is reduced to a minimum.

Figure 5:
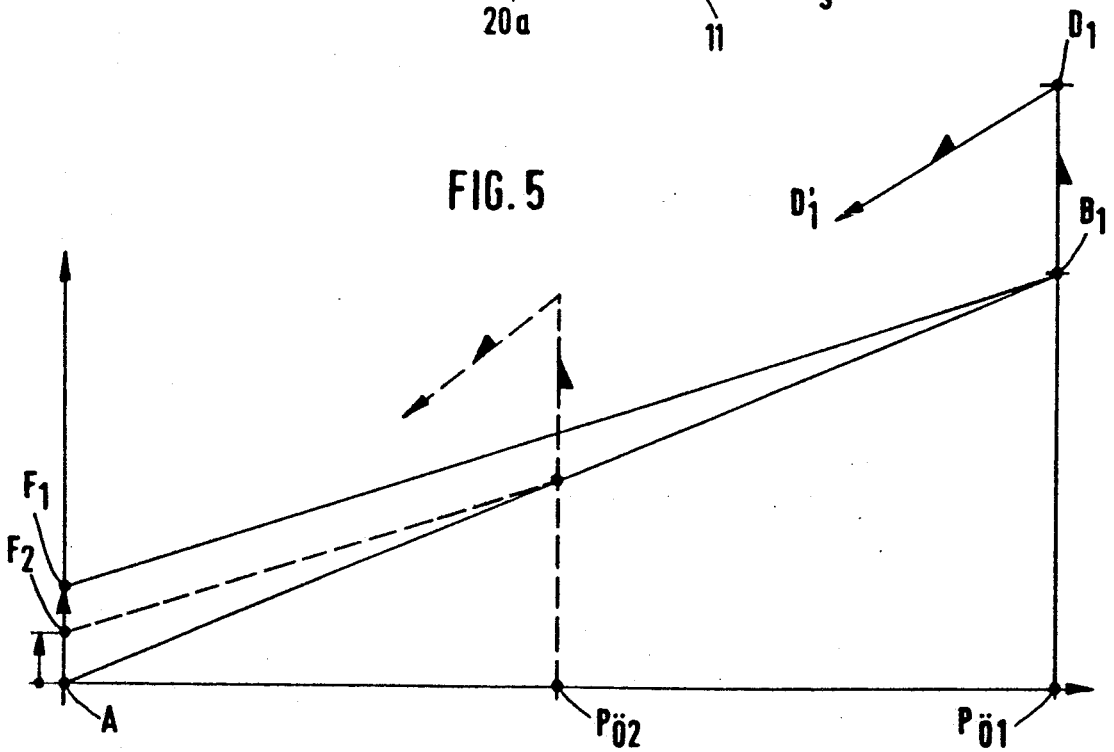
FIG. 5 shows a force-pressure diagram of the forces at the valve needle.

FIG. 5 shows the forces acting on the valve needle 4 (FIG. 1) as a function of the fuel pressure P. The straight line $A\text{-}B_1$ represents the course of the force acting on the valve needle 4 in the closing position. This force results exclusively from the fuel pressure, which acts on the surface corresponding to the diameter difference $d_2-d_1$ of the valve needle 4 (FIG. 1) in the opening direction of the valve needle.

The straight line $F_1-B_1$ results from the force $F_1$ of the pre-loaded pressure spring 5 (FIG. 1) and force of the auxiliary piston 8. This force acts in the closing direction of the valve needle 4. When the fuel pressure equals zero, only the force $F_1$ of the pressure spring 5 acts on the valve needle 4. With increasing pressure P the closing force increases due to the increasing force of the auxiliary piston 8. At the point $B_1$ the force acting in the opening direction of the valve needle 4, represented as a straight line $A\text{-}B_1$, reaches the value of the closing force represented by the straight line $F_1-B_1$. The valve is opened at the pressure $P_{01}$. The equation for the parameters involved in the opening process is as follows:

$$P_{01} = \frac{4}{\pi} \cdot \frac{F_1}{(d_2^2 - d_1^2 - d_3^2)}$$

with the parameters having the following meanings:

$F_1$ = force of the pre-loaded spring $d_2$ = diameter of the valve needle shaft $d_1$ = diameter of the valve needle seat $d_3$ = diameter of the auxiliary piston $P_{01}$ = opening pressure.

Upon opening of the valve needle 4, the pressure surface effective in the opening direction is increased from the previous value determined by the difference in diameters $d_2-d_1$, to a value, corresponding to the diameter $d_2$, and the force acting on the valve needle increases suddenly to the value $D_1=P_{01}A$ with $$A = \frac{d_2^2\pi}{4}.$$

Due to the injection of the fuel into the combustion chamber the pressure at the point $P_{01}$ decreases again, as shown by the straight line $D_1-D_1'$. When the annular notch 12 (FIG. 1) is open, the cycle of the valve needle 4 begins again. The frequency of the opening and closing of the valve needle reaches a range of a few kHz.

The course of events at the valve needle are represented in a qualitative manner in FIGS. 6 through 9.

Figure 6:
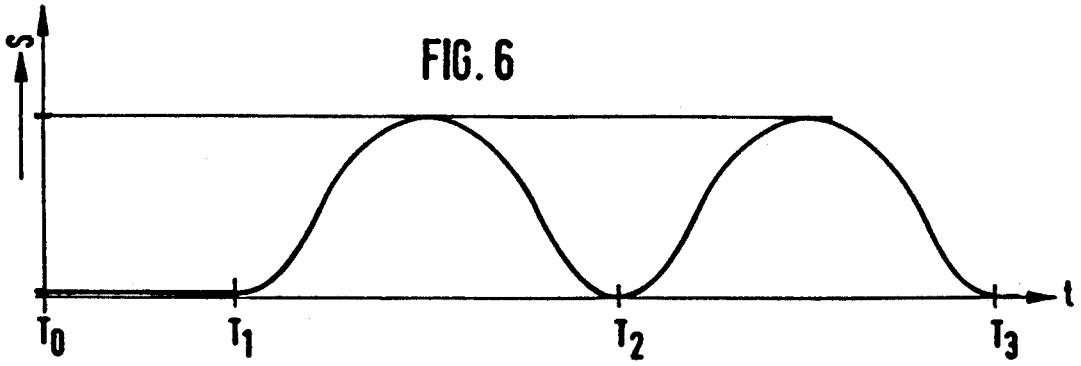
FIG. 6–9 show diagrams of the movement parameters of the valve needle as a function of time.

FIG. 6 shows the path of the valve needle as a function of time t. At the point $T_1$ the valve needle begins to lift and reaches its maximum stroke, when the shoulder of the valve needle shaft 10 contacts the abutment 18 (FIG. 1). Due to the injection of the fuel into the combustion chamber, the pressure drops again, because the fuel supply is interrupted by the valve needle shaft 10 (cf. FIG. 1). At the point $T_2$, the valve needle 4 softly lands in its seat or is subjected to a reversal of movement shortly before it reaches its seat. Then the cycle starts over.

Figure 7:
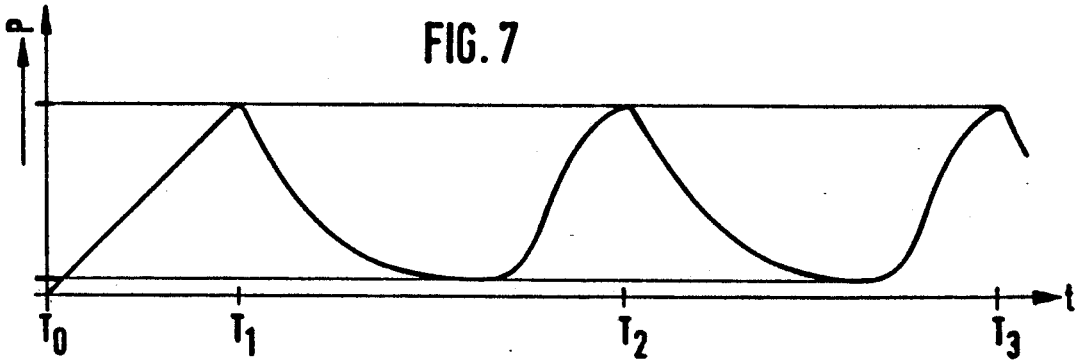

The course of the pressure as a function of time t is represented in FIG. 7. The pressure first rises as a linear function of time until it reaches the required opening pressure $P_O$ (cf. FIG. 5). At the point $T_1$, the valve needle opens and the line pressure decreases due to the injection of the fuel into the combustion chamber. Before the valve needle can reach the seat (point $T_2$), fuel is again supplied to the combustion chamber due to the opening of the annular notch 12 (FIG. 1). The pressure rises again until at the point $T_2$ the opening pressure $P_O$ is reached.

Figure 8:
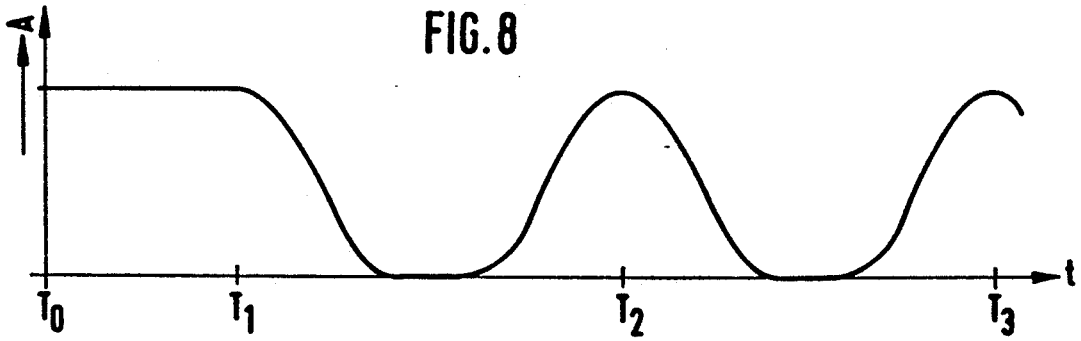

The stroke of the valve needle 4 according to FIG. 6 determines the release cross-section A. Its course over time is represented in FIG. 8.

Figure 9:
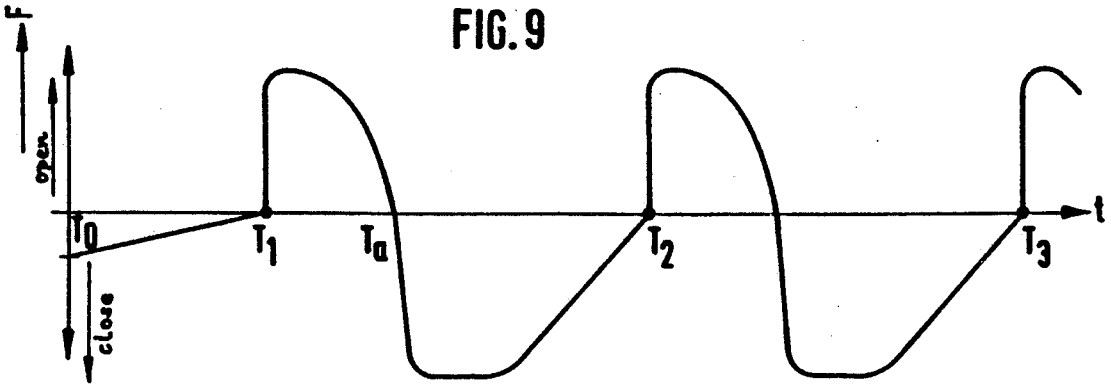

FIG. 9 shows the course of the force F acting on the valve needle. At the time $T_O$ only the force of the pressure spring 5 (FIG. 1) in the direction of closing acts on the valve needle. With increasing fuel pressure the force F is countered by the differential force corresponding to the diameters $d_1$, $d_2$, and $d_3$ (FIG. 5). At T the force in the opening direction surmounts the force in the closing direction. The force in the opening direction suddenly increases due to the availability of the diameter $d_2$ (step from point $B_1$ to $D_1$ in FIG. 5). Due to the fuel injection into the combustion chambers the force decreases again until at the point $T_a$, the forces are equal. Then the closing force, a combination of the spring force and the force acting on the auxiliary piston, surmounts the opening force generating in the pressure chamber 11 upon acting on the diameter $d_2$, and forces the closing of the valve at the point $T_2$.

The present invention is, of course, in no way restricted to the specific disclosure of the specification, examples and drawings, but also encompasses any modifications within the scope of the appended claims.

What I claim is:

1. A method for intermittently injecting fuel into a combustion chamber of a combustion engine, said method comprising the steps of:

closing and opening a valve needle of an injection valve exclusively by the interaction of a force source means acting in a closing direction of said valve and a force generated by said fuel exerting pressure on said valve needle in an opening direction of said valve, said valve having only one fuel path extending between a fuel inlet bore and a pressure chamber disposed about the valve needle, said fuel in said pressure chamber exerting said pressure on said valve needle; and controlling the fuel pressure acting on said valve needle by moving said valve needle such that said fuel path, in a closed position of said valve needle, is open, and after said valve needle reaches an opened position, said fuel path is closed.

2. In an injection valve for intermittently injecting fuel into a combustion chamber of a combustion engine wherein closing and opening of a valve needle of the injection valve is made possible exclusively by the interaction of a force source means acting in a closing direction of said valve and a force generated by fuel exerting pressure on said valve needle, with said valve needle having a pressure shoulder disposed in a pressure chamber of a valve body at an end opposite said force source means, said pressure shoulder forming a transition of said valve needle to a valve needle shaft, the improvement wherein:

said valve needle shaft has an annular notch for opening or closing a fuel path from a first groove, that is connectable via a connecting line means to a fuel inlet bore, to a second groove, that is connected via a line to said pressure chamber, and with said first and second groove being disposed in said valve body and being arranged in a same plane and along a common axis opposite from one another, and with said fuel path being closed when said valve needle is in an opening position.

3. An injection valve according to claim 2, in which said first and said second groove are in the form of a single annular groove surrounding said annular notch in a common plane therewith when said valve needle is closed, with said connecting line means comprising at least one diagonal bore disposed in said needle shaft and opening into said annula notch and said pressure shoulder.

4. An injection valve according to claim 2, in which said force source means includes a pressure spring, disposed at said valve needle and being loaded in said closing direction of said valve needle, with an auxiliary piston which is operatively associated with said valve needle and assists said pressure spring.

5. An injection valve according to claim 2, in which said force source means is assisted by an additional piston, with a spring seat being said additional piston which is actuatable via a control line in a valve holder by a pressure generator.

* * * * *